US005713179A

United States Patent [19]

Semba

[11] Patent Number: 5,713,179

[45] Date of Patent: Feb. 3, 1998

[54] COMBINATION OF SHEET ROLL WITH SUBSHAFT, PRODUCING APPARATUS THEREOF, PACKAGING APPARATUS THEREOF, AND PRODUCTION SYSTEM THEREOF

[75] Inventor: Yoshikimi Semba, Tokyo-To, Japan

[73] Assignee: Dai Nippon Printing Co. Ltd., Japan

[21] Appl. No.: 533,791

[22] Filed: Sep. 26, 1995

[30] Foreign Application Priority Data

Sep. 30, 1994 [JP] Japan ..... 6-236878
Dec. 27, 1994 [JP] Japan ..... 6-324439

[51] Int. Cl.[6] ..... B65B 63/04

[52] U.S. Cl. ..... 53/118; 53/520; 53/544; 53/582; 242/532.1; 242/538.3

[58] Field of Search ..... 53/118, 430, 520, 53/544, 582, 587, 588, 589; 206/391, 393, 398, 410; 242/532.1, 538, 538.3

[56] References Cited

U.S. PATENT DOCUMENTS

| | | | |
|---|---|---|---|
| 2,721,653 | 10/1955 | Billihge | 206/393 X |
| 2,873,014 | 2/1959 | Lambert | 206/391 X |
| 3,151,723 | 10/1964 | Wendt | 206/393 X |
| 3,186,543 | 6/1965 | Minick et al. | 53/430 X |
| 3,209,477 | 10/1965 | McGaffey | 242/538.3 X |
| 3,226,816 | 1/1966 | Wilson et al. | 53/118 X |
| 3,325,889 | 6/1967 | Meli et al. | 53/118 X |
| 3,457,627 | 7/1969 | Napor et al. | 53/118 X |
| 3,476,238 | 11/1969 | Wright et al. | 206/393 |
| 3,832,213 | 8/1974 | Brenner | 53/118 X |
| 4,617,719 | 10/1986 | Woodley | 242/532.1 X |
| 4,648,562 | 3/1987 | Kiuchi | 242/532.1 X |
| 4,702,631 | 10/1987 | Watanabe | 242/538.3 X |
| 4,778,713 | 10/1988 | Akao | 206/455 X |
| 4,811,911 | 3/1989 | Toral et al. | 242/532.1 |
| 4,863,110 | 9/1989 | Sakaguchi et al. | 242/532.1 |
| 4,892,425 | 1/1990 | Shimizu et al. | 242/538.3 X |
| 4,912,510 | 3/1990 | Ogura et al. | 206/393 X |
| 4,970,531 | 11/1990 | Shimizu et al. | 242/538.3 X |
| 4,984,413 | 1/1991 | Cosmo | 53/465 |
| 4,998,117 | 3/1991 | Shibuya et al. | 242/538.3 X |
| 5,079,565 | 1/1992 | Shimizu et al. | 242/538.3 X |
| 5,280,862 | 1/1994 | Oya et al. | 242/532.1 |
| 5,353,933 | 10/1994 | Takahashi et al. | 206/410 X |
| 5,415,486 | 5/1995 | Wouters et al. | 206/397 X |
| 5,419,098 | 5/1995 | Meier | 53/544 X |
| 5,536,094 | 7/1996 | Kondo | 206/393 X |
| 5,547,298 | 8/1996 | Wouters et al. | 206/393 X |

*Primary Examiner*—Daniel Moon
*Attorney, Agent, or Firm*—Parkhurst & Wendel

[57] ABSTRACT

An uncrumpling and cutting apparatus cuts a predetermined length of an end portion of a heat transfer recording sheet of a sheet roll obtained by winding the heat transfer recording sheet around an outer periphery of a shaft roll, and a lead sheet sticking apparatus sticks an end of a lead sheet to the end portion of the heat transfer recording sheet. A subshaft sticking apparatus sticks a subshaft to the lead sheet, and a lead sheet winding apparatus winds up the lead sheet to wrap the sheet roll and the subshaft. A tying portion ties a combination of a sheet roll with a subshaft with a strip, thereby bundling the combination. Then the combination thus tied is packed in a package bag by a packaging portion. A transferring and mounting portion lays an even number of combinations as alternately reversing orientations thereof, and an encasing portion encases the combinations thus laid in a container.

22 Claims, 13 Drawing Sheets

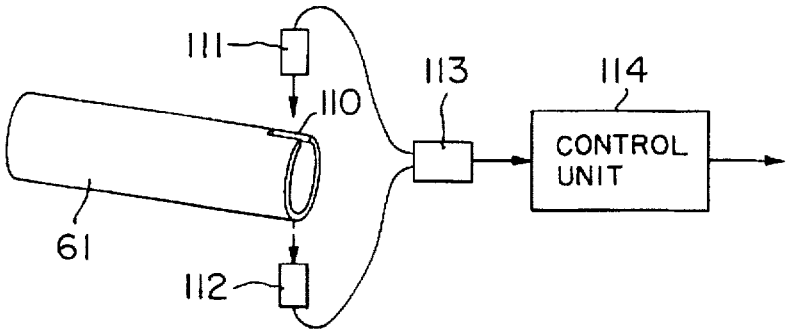
FIG. 10
FIG.11A
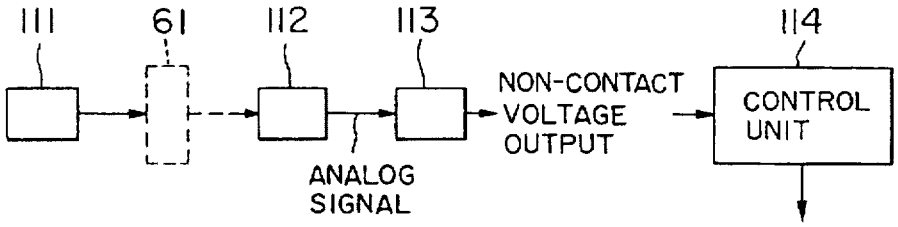
FIG.11B
FIG.11C
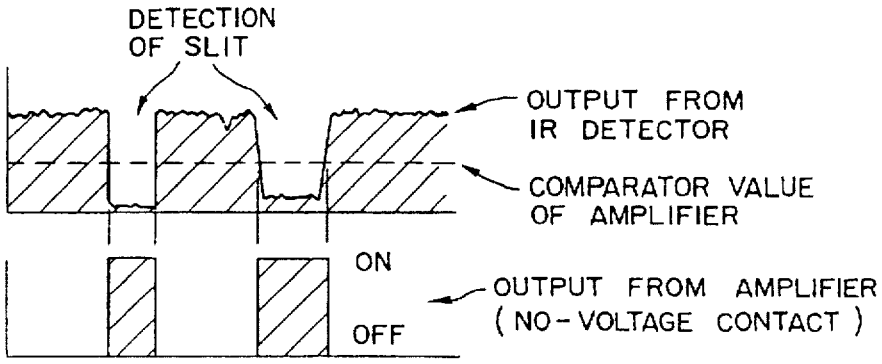

COMBINATION OF SHEET ROLL WITH SUBSHAFT, PRODUCING APPARATUS THEREOF, PACKAGING APPARATUS THEREOF, AND PRODUCTION SYSTEM THEREOF

BACKGROUND OF THE INVENTION

1. Field of the Invention

The present invention relates to a combination of a sheet roll comprised of a heat transfer recording sheet used in thermal facsimile devices with a subshaft, a packaging apparatus thereof, and a production system thereof.

2. Related Background Art

Conventional facsimile devices use a heat transfer recording sheet rolled on a roll shaft in the form of roll. This recording sheet is also called as a donor, which has such a structure that a hot melt ink layer consisting of a binder of wax, resins, etc., and a color agent is laid on one surface of a thin, plastic film base, for example, of polyester. The ink layer of recording sheet is overlaid on paper, and the back face of recording sheet is heated by a heating means such as a thermal head to transfer ink to the paper, thereby effecting printing. Such facsimile devices are provided with an apparatus for indicating the end of recording sheet.

For indication of the end of recording sheet, an end mark with a reflective surface is normally provided in the vicinity of a shaft fixed end (terminal end) of recording sheet to a roll shaft. This end mark is given on either the hot melt ink layer side or the opposite side thereto of the recording sheet, and is optically detected by a sensor having a light source and a photodetector. This end mark is printed on the recording sheet by flexography or gravure printing.

As described above, the heat transfer recording sheet is wound in a roll form around a roll shaft, which is used in facsimile devices. Incidentally, the recording sheet wound around a roll shaft forms a sheet roll, which needs a subshaft for rolling the used recording sheet fed out from the roll shaft when used in facsimile devices. In this case, the leading end of the recording sheet is rolled on the subshaft, so that the sheet roll is combined with the subshaft to compose a combination. Every combination is transported or stored.

Meanwhile, such a combination of a sheet roll with a subshaft is set in a container and thereafter is packaged, but presently there is no method for quickly and surely packaging the combination.

SUMMARY OF THE INVENTION

The present invention has been accomplished taking account of the above points, and an object of the invention is to provide a combination of a sheet roll with a subshaft, a producing apparatus of the combination, a packaging apparatus of the combination, and a production system of the combination.

A first feature of the present invention is a combination system for producing a combination of a sheet roll with a subshaft, comprising: a combination producing apparatus for winding up a lead sheet to wrap a sheet roll obtained by winding a heat transfer recording sheet around an outer periphery of a roll shaft, and a subshaft with a smaller diameter than that of the sheet roll, thereby producing the combination of a sheet roll with a subshaft; and a combination packaging apparatus for packaging the combination of a sheet roll with a subshaft, with a package bag and transferring packaged combinations into a container as alternately reversing orientations thereof to encase the combinations in the container.

A second feature of the present invention is a combination producing apparatus for producing a combination of a sheet roll with a subshaft, comprising: an uncrumpling and cutting apparatus for cutting an end portion of a heat transfer recording sheet of a sheet roll obtained by winding the heat transfer recording sheet around an outer periphery of a roll shaft, by a predetermined length; a lead sheet sticking apparatus provided on a downstream side of said uncrumpling and cutting apparatus, for making one side edge of a lead sheet of a predetermined length overlap with the cut end portion of the heat transfer recording sheet thus cut and sticking said one side edge to the end portion by sticking means; a subshaft sticking apparatus provided on a downstream side of said lead sheet sticking apparatus, for sticking a subshaft to another side edge of the lead sheet stuck to said sheet roll; and a lead sheet winding apparatus provided on a downstream side of said subshaft sticking apparatus, for winding up said lead sheet so as to wrap said sheet roll and said subshaft with said lead sheet.

A third feature of the present invention is a combination packaging apparatus for packaging a combination of a sheet roll with a subshaft, comprising: a tying portion for tying with a strip a combination of a sheet roll with a subshaft, formed by winding up a lead sheet to wrap therewith the sheet roll obtained by winding a heat transfer recording sheet around an outer periphery of a roll shaft, and the subshaft with a smaller diameter than that of the sheet roll; a packaging portion provided on a downstream side of the tying portion, for packaging said combination thus tied with a package bag; a transferring and mounting portion provided on a downstream side of the packaging portion, for laying combinations packaged in package bags as alternately reversing orientations thereof; and an encasing portion provided on a downstream side of the transferring and mounting portion, for encasing the combinations laid by the transferring and mounting portion, in a container.

According to the first feature, the combination producing system can form a combination by rolling to wrap a sheet roll and a subshaft with a smaller diameter than that of the sheet roll with a lead film, and can easily and continuously pack such combinations in containers.

According to the second feature, when a sheet roll is put into the uncrumpling and cutting apparatus, the uncrumpling and cutting apparatus cuts the end portion of heat transfer recording sheet in the sheet roll by a predetermined length and uncrumples the recording sheet. Then the sheet roll is carried to the lead sheet sticking apparatus, and the lead sheet sticking apparatus sticks one side edge of a lead sheet of a predetermined length to the end portion of heat transfer recording sheet. Next, the sheet roll is carried to the subshaft sticking apparatus, and the subshaft sticking apparatus sticks the other side edge of the lead sheet to the subshaft. The sheet roll with the subshaft stuck to the other edge of the lead sheet is then carried to the lead sheet winding apparatus, and the lead sheet winding apparatus winds up the lead sheet to wrap the sheet roll and the subshaft therewith, thereby obtaining the combination of the sheet roll with the subshaft.

According to the third feature, the tying portion of the combination packaging apparatus ties the combination of the sheet roll with the subshaft in a bundle with a strip, and the packaging portion packages the tied combination in a package bag. Combinations each packaged in package bags are laid as alternately reversing their orientations in order by the transferring and mounting portion, and the combinations laid by the transferring and mounting portion are encased in containers by the encasing portion.

BRIEF DESCRIPTION OF THE DRAWINGS

FIG. 10 is a schematic drawing to show a slit detecting mechanism in a subshaft supplying apparatus;

FIGS. 11A–11C are drawings to show a flow of signal and an amplitude thereof in the slit detecting mechanism of the subshaft supplying apparatus;

DESCRIPTION OF THE PREFERRED EMBODIMENTS

Heat Transfer Recording Sheet

Figure 1:
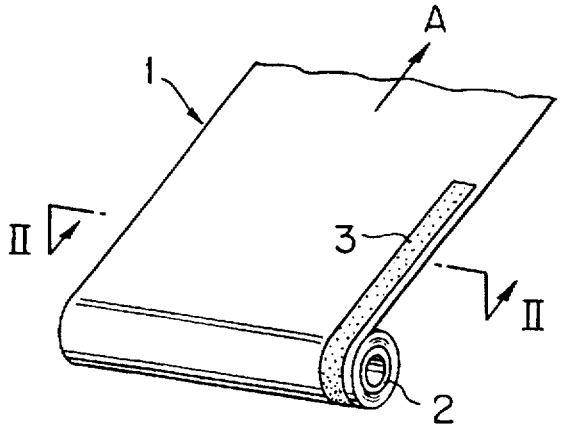
FIG. 1 is a perspective view to show a heat transfer recording sheet for forming a combination of a sheet roll with a subshaft according to the present invention.

The heat transfer recording sheet is first described referring to FIG. 1. As shown in FIG. 1, the heat transfer recording sheet drawn out from a roll shaft 2 is pulled in the direction of arrow A up to a state where a small part of the sheet remains on the side of the roll shaft 2.

Figure 2:
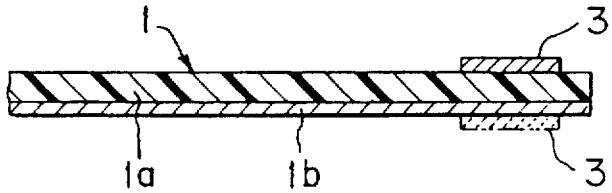
FIG. 2 is a cross section along II—II line in FIG. 1.

As shown in FIG. 2, which is a cross section along II—II line in FIG. 1, the recording sheet 1 has a base film 1*a*, and a hot melt ink layer 1*b*, provided on one face of the base film 1*a*, for recording of copy as aimed by heat transfer. Among them, the base film 1*a* is made of a plastic such as polyester, polypropylene, cellophane acetate, or polycarbonate, or a paper such as condenser paper or paraffin paper. Among them a polyester base film 1*a* is preferred. The hot melt ink layer 1*b* is made of a mixture of a known pigment a synthetic resin, and a wax. This hot melt ink layer has a thickness of 3 to 8 microns.

As shown in FIG. 1 and FIG. 2, a narrow end mark 3 is provided along the longitudinal direction and in a portion located at a predetermined distance from the fixed end of the recording sheet 1 to the roll shaft 2. Although this end mark 3 is provided on the side of the base film 1*a*, it may be provided on the side of the hot melt ink layer 1*b*.

The end mark 3 is a light reflecting layer having a thickness of 1 to 6 microns, printed by gravure printing. Thus, the end mark is silvery or golden, whereby it covers the black base film or the hot melt ink layer and forms an effective reflective surface.

Inks for gravure printing possibly used for formation of end mark 3 are as follows.

| Gravure Printing Ink 1 | |
|---|---|
| aluminum paste | 13% |
| "VA-HR430" (trade name) | 87% |
| wherein VA-HR430 consists of: | |
| vinylidene fluoride | 8.7% |
| fluorocarbon | 6.5% |
| methyl ethyl ketone | 47.0% |
| toluene | 9.6% |
| "M-AT BC TF" (trade name) | 21.7% |
| "M-AT Mark FC113" (trade name) | 6.5% |

Here, "M-AT BC TF" consists of 10% of Teflon (trade name) powder (polytetrafluoroethylene), 40% of acrylpolyol, 30% of methyl ethyl ketone, and 20% of an additive. Also, "M-AT Mark FC113" consists of 30% of a graft polymer wax, 65% of toluene, and 5% of ethyl acetate.

| Gravure Printing Ink 2 | |
|---|---|
| aluminum paste | 8% |
| nitrocellulose | 16.5% |
| ester gum | 3.0% |
| wax | 4.5% |
| castor oil | 3.0% |
| dioctylmalate | 3.0% |
| toluene | 20.0% |
| isopropyl alcohol | 14.0% |
| ethyl alcohol | 28.0% |
| **Gravure Printing Ink 3** | |
| gravure printing ink 2 | 64.0% |
| "CM950White" (trade name) | 36.0% |

"CM950White" (trade name) contains 24% of aluminum oxide, 26.0% of varnish, and 14.0% of wax.

Figure 3:
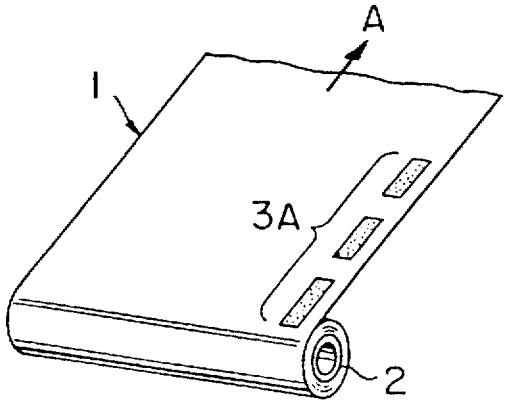
FIG. 3 is a drawing, similar to FIG. 1, to show another heat transfer recording sheet.

A second end mark 3A may be provided at a farther point than the first end mark 3 with respect to the fixed end of the recording sheet 1 to the roll shaft 2, as shown in FIG. 3. The second end mark 3A is formed in a series of relatively short strip patterns by gravure printing. This second end mark 3A is for informing a user of the approaching end of recording sheet 1 before the first end mark 3.

Figure 4:
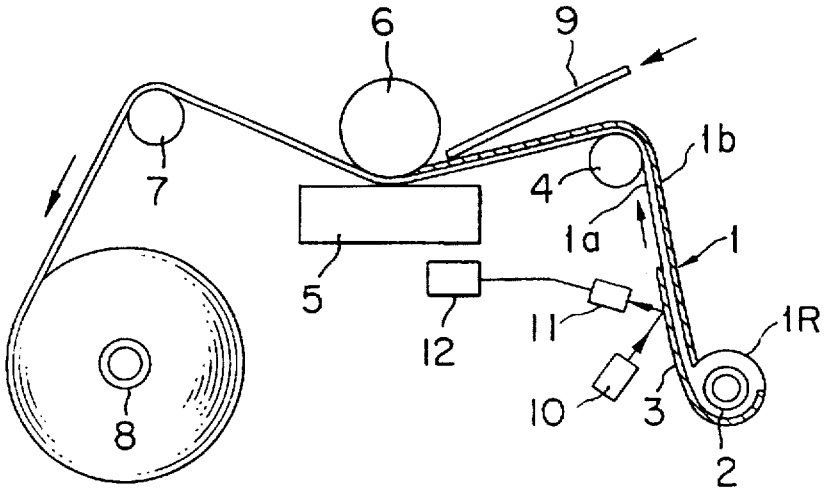
FIG. 4 is a schematic drawing to show a state for optically detecting an end mark provided on the heat transfer recording sheet.

Next described with FIG. 4 is a method for using the heat transfer recording sheet 1. As shown in FIG. 4, the heat transfer recording sheet 1 drawn out of a supply roll 1R of roll shaft 2 moves past a guide roll 4 in the arrow direction and then goes into between a thermal head 5 and a backup roll 6. After that, the heat transfer recording sheet 1 moves past another guide roll 7 and then is wound up by a winding roll shaft 8.

A piece of paper 9 for recording is supplied from a sheet supply tray (not shown) to be laid on the recording sheet 1. While the paper 9 and sheet 1 move in contact with each other between the thermal head 5 and the backup roll 6, heating of the thermal head causes the hot melt ink to be thermally transferred onto the paper 9 to effect recording thereon.

When the recording sheet 1 is pulled up to the vicinity of the fixed end on the supply roll shaft, the reflective end mark 3 appears as shown in FIG. 1. As shown in FIG. 4, this end mark 3 reaches a position where it is opposed to an infrared sensor composed of a light source 10 and a photodetector 11. Infrared rays emitted from the light source 10 reach the end mark 3 to be reflected thereby and then reach the photodetector 11. In this manner the infrared sensor detects the end of sheet 1. An alarm 12 is connected to the photodetector 11 and gives an alarm indicating that the recording sheet 1 is approaching the end when the end mark 3 is detected.

Figure 14:
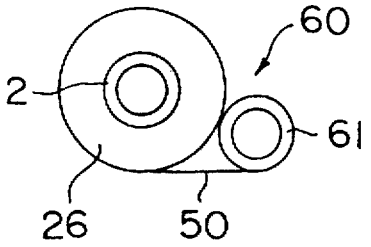
FIG. 14 is a drawing to show a combination of a sheet roll with a subshaft.

The heat transfer recording sheet 1 in the above arrangement is wound around the roll shaft 2 to form a sheet roll 26, and a subshaft 61 for winding the used sheet therearound is attached to the opposite end of the heat transfer recording sheet 1 to the roll shaft 2. In this case, the subshaft 61 is attached through a lead film 50 to the end of the heat transfer recording sheet 1, and this lead film 50 is wound to wrap the sheet roll 26 and subshaft 61, thereby obtaining a combination 60 of the sheet roll 26 with the subshaft 61 (as shown in FIG. 14). In the combination 60, the diameter of the sheet roll 26 is considerably larger than that of the subshaft 61.

Combination Producing Apparatus

Figure 5:
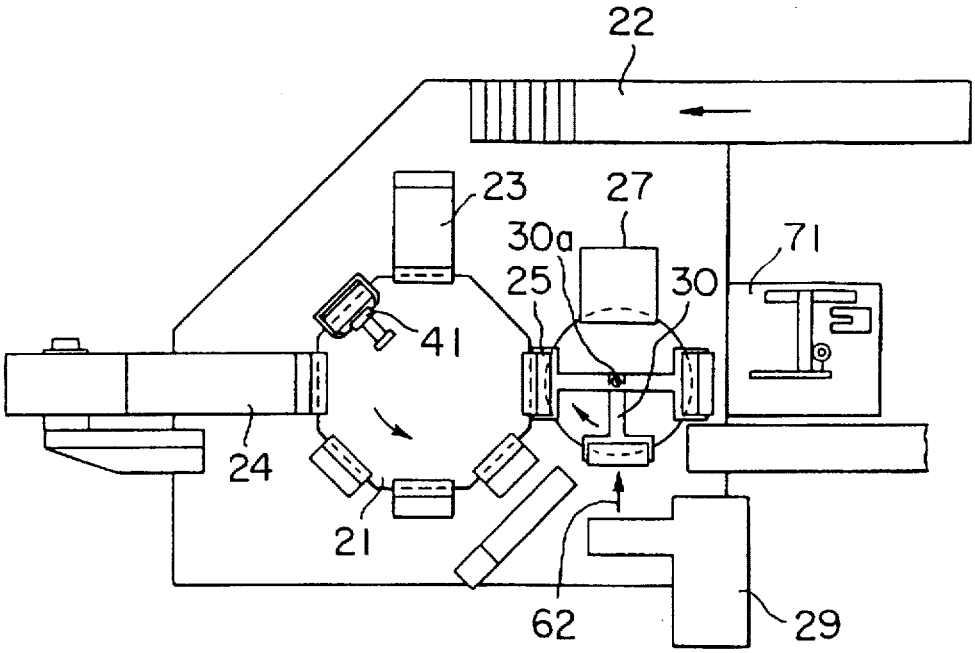
FIG. 5 is a drawing to show a combination producing apparatus for producing a combination of a sheet roll with a subshaft according to the present invention.

Next described referring to FIG. 5 to FIG. 12 is a producing apparatus for producing the combination 60 of the sheet roll 26 with the subshaft 61. As shown in FIG. 5, the producing apparatus of the combination of the sheet roll with the subshaft is provided with a turn table 21, and an uncrumpling and cutting apparatus 23 mounted to the turn table 21, for cutting the end portion of the heat transfer recording sheet 1 of the sheet roll 26 by a predetermined length. The sheet roll 26 is formed by winding the heat transfer recording sheet 1 around the outer periphery of the roll shaft 2, and this sheet roll 26 is put into a sheet roll input apparatus 22 to be carried to the uncrumpling and cutting apparatus 23.

Figure 7:
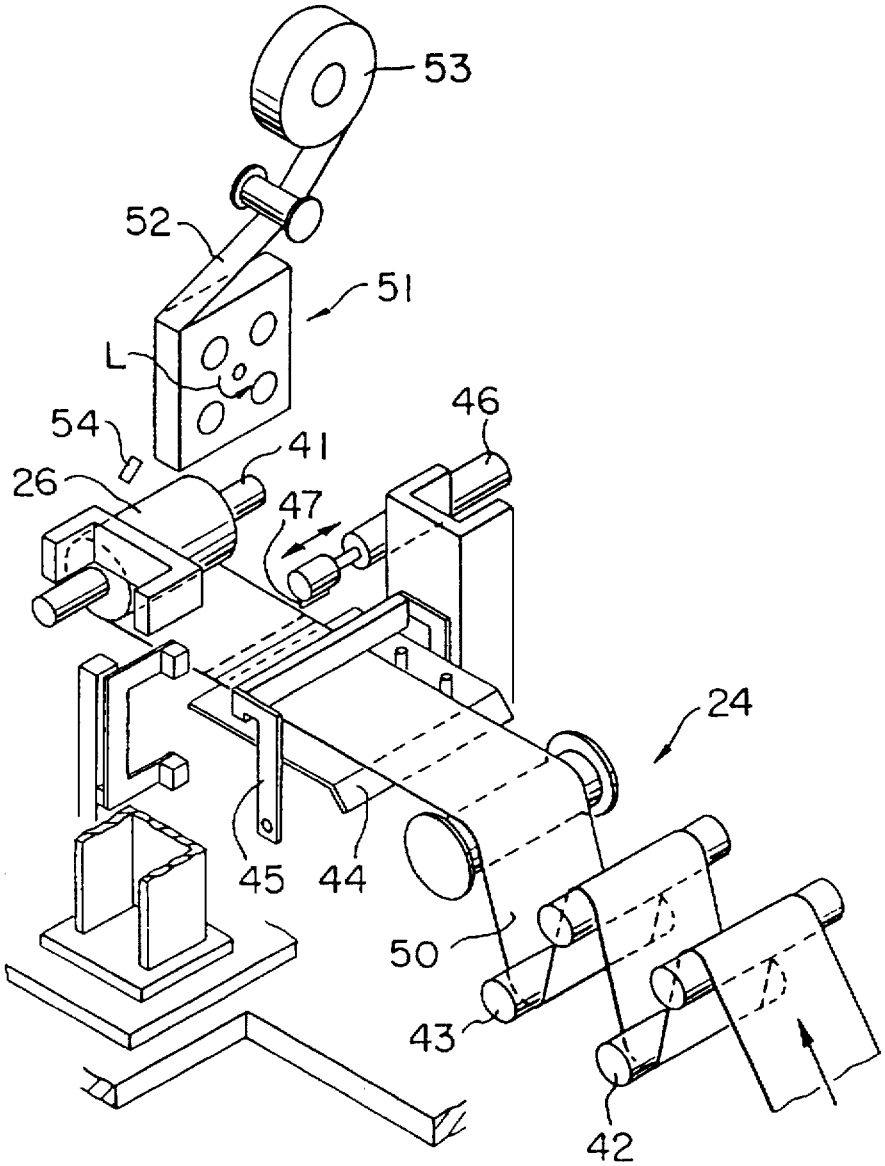
FIG. 7 is a schematic drawing to show a lead sheet sticking apparatus.
Figure 8:
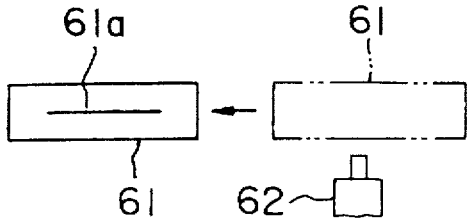
FIG. 8 is a drawing to show an operation of applying an adhesive to a subshaft by a hot melt gun.

After cut in end portion by the uncrumpling and cutting apparatus 23, the sheet roll 26 is then carried to a lead sheet sticking apparatus 24 by the turn table 21. In this lead sheet sticking apparatus 24, one side edge of a lead film (lead sheet) 50 (FIGS. 9A–9D) of a predetermined length is superimposed on the cut end of the heat transfer recording sheet 1, and they are stuck to each other by pressure-sensitive adhesion means, for example such as a pressure-sensitive adhesive tape (FIG. 7). Further, the sheet roll 26 with the lead sheet 50 stuck thereto is carried by the turn table 21 to a subshaft sticking position 25, where a subshaft 61 is stuck to the lead sheet 50 by a subshaft sticking apparatus.

The subshaft sticking apparatus is composed of a means for applying an adhesive 61*a* to the subshaft 61 supplied from a subshaft supplying apparatus 29 provided at an arbitrary position, and a means for carrying the subshaft 61 to the subshaft sticking position 25 and sticking it to the lead sheet 50.

The adhesive 61*a* is made of a hot melt resin etc., and is applied along an axial direction of the subshaft 61 by a hot melt resin applicator 62 such as a hot melt gun during a period when the subshaft 61 is carried from the subshaft supplying apparatus 29 to the subshaft sticking position 25. A lead sheet winding apparatus 27 for winding the lead sheet 50 so as to wrap the sheet roll 26 and subshaft 61 is provided on the downstream side of the subshaft sticking position 25.

Figure 6:
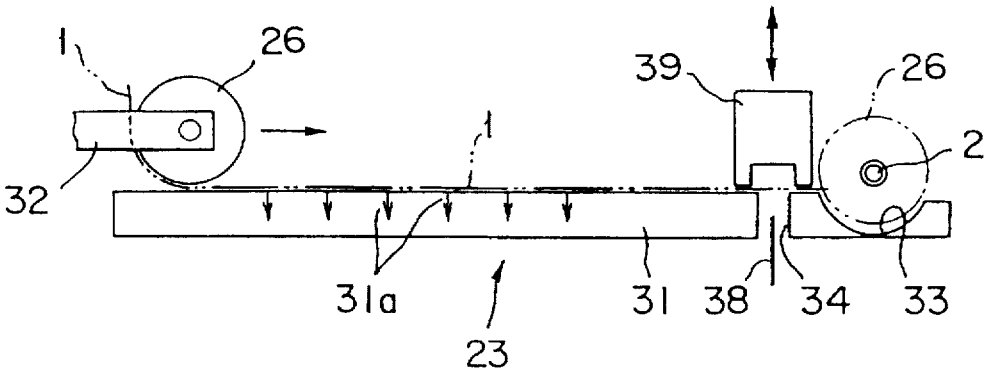
FIG. 6 is a schematic drawing to show an uncrumpling and cutting apparatus.

The constituent portions will be described in detail one by one. As shown in FIG. 6, the uncrumpling and cutting apparatus 23 has a horizontal support table 31 with suction portions 31*a* on the top face thereof, and a pair of arms 32 for holding and rotating the sheet roll 26 on the horizontal support table 31 so as to leave a predetermined length of the heat transfer recording sheet 1 on the horizontal support table 31.

The sheet roll 26 is held by the pair of arms 32 on the upstream side of the horizontal support table 31 and rotates to move toward the downstream side of the horizontal support table 31 to become fit in a recess 33 on the downstream side of the horizontal support table 31. On the downstream side of the horizontal support table 31 there is a through hole 34 for inserting a cutter 38 thereinto, and the cutter 38 extends upward from the through hole 34 to cut the heat transfer recording sheet 1 and then to go into a receiver 39 provided above the horizontal support table 31.

The lead sheet sticking apparatus is next described referring to FIG. 7. As shown in FIG. 7, the lead sheet sticking apparatus 24 has a roll support portion 41 for rotatably supporting the sheet roll 26, and rollers 42, 43 for supplying the lead sheet 50 to the sheet roll 26. The end of the sheet roll 26 and the end of the lead sheet 50 are made to overlap with each other on a guide plate (mount stage) 44, and a cutting apparatus 47 for cutting the lead sheet 50 is provided near the guide plate 44 so as to be movable by an air cylinder 46.

Above the guide plate 44 there is provided a lead sheet stopper 45 for press-holding the lead sheet 50 on the guide plate 44. Further, a sticking drum 51 in a nearly square shape is provided above the guide plate 44 so as to be rotatable and vertically movable. The sticking drum 51 has four peripheral faces, being adsorbing surface, so that a non-adhesive surface of the adhesive tape 52 fed out from a tape supply portion 53 is adsorbed to the four adsorbing faces.

Below the sticking drum 51 there is a cutter 54 for cutting the adhesive tape 52 adsorbed to the bottom face of the sticking drum 51.

As shown in FIGS. 9A–9D, the lead sheet winding apparatus 27 has a roll shaft support portion 65 for supporting and rotating the roll shaft 2 of the sheet roll 26, and a subshaft support portion 66 for supporting and rotating the subshaft 61.

Next described is the operation of the present embodiment constructed in the above structure. First, in FIG. 5, the sheet roll 26 with the heat transfer recording sheet 1 wound around the outer periphery of the roll shaft 2 is produced at a prestep, and the sheet roll 26 is put into the sheet roll input apparatus 22 to be carried to the uncrumpling and cutting apparatus 23, for example by an arm having at a distal end thereof a mechanism for pinching the side faces of roll to freely hold it.

In the uncrumpling and cutting apparatus 23, as shown in FIG. 6, the sheet roll 26 is first supported by the arms 32 to be located on the left side on the horizontal support table 31. Next, air is blown against the fore end of the heat transfer recording sheet 1 to urge the heat transfer recording sheet 1 to the horizontal support table 31, and then the heat transfer recording sheet 1 is sucked by the suction portions 31*a* in the horizontal support table 31. At the same time, the sheet roll 26 is rotated to move to the right on the horizontal support table 31 by means of the arms 32 and to become fit in the recess 33, so that the heat transfer recording sheet 1 is fed out from the sheet roll 26 by a predetermined length from the fore end.

Then the cutter 38 cuts the sheet 1 through the through hole 34 and thereafter the cutter 38 goes into the receiver 39.

In this manner the end portion of the heat transfer recording sheet 1 is cut by the predetermined length from the sheet roll 26. The end portion of the heat transfer recording sheet 1 is a portion to be easily crumpled across about a winding, and the uncrumpling and cutting apparatus 23 can uncrumple the heat transfer recording sheet 1 by cutting it.

Then the sheet roll 26 is carried to the lead sheet sticking apparatus 24.

The carrying mechanism may employ any conventionally known method, and a preferred method is, for example, a method for holding the sheet roll 26 by a roll support portion 41 installed on the turn table and then rotating the turn table to carry the sheet roll 26. In the lead sheet sticking apparatus 24, as shown in FIG. 7, the end portion of the lead sheet 50, sent through the rollers 42, 43 etc. in order up to on the guide plate 44, is first made to overlap with the end portion of the heat transfer recording sheet 1 of the sheet roll 26 supported by the roll support portion 41, on the guide plate 44. In this case, the lead sheet 50 is made to overlap with a surface of the heat transfer recording sheet 1 on the opposite side to the hot melt ink layer 1*b*. The lead sheet 50 is stopped as urged against the guide plate 44 by the lead sheet stopper 45.

Next, the sticking drum 51 drops from above to stick the end portion of the lead sheet 50 to the end portion of the heat transfer recording sheet 1 by the adhesive tape 52 adsorbed on the bottom face of the sticking drum 51.

Then the sticking drum 51 ascends and the lead sheet stopper 45 releases the press of the lead sheet 50. Then the roll support portion 41 rotates the sheet roll 26, whereby the heat transfer recording sheet 1 and lead sheet 50 are slightly wound up to the sheet roll 26.

The roll support portion 41 may be provided as an extra element in the lead sheet sticking apparatus, but it is preferred that the roll support portion installed on the turn table also include the function.

Next, the air cylinder 46 forces the cutting apparatus 47 toward the lead sheet 50, so that the cutting apparatus 47 cuts the lead sheet 50. In this manner the lead sheet 50 of the predetermined length is stuck to the end portion of the heat transfer recording sheet 1. The sheet roll 26 thus obtained by sticking the lead sheet 50 to the heat transfer recording sheet 1 is then supplied to the subshaft sticking position 25 by the turn table 21.

After that, the lead sheet 50 is slightly pulled back to the rollers 42, 43, and the lead sheet stopper 45 presses to stop the lead sheet 50 when the cut end of the lead sheet 50 reaches above the guide plate 44, thereby waiting for a subsequent operation of sticking the lead sheet 50 to the heat transfer recording sheet of a next sheet roll 26.

On the other hand, the sticking drum 51 rotates 90 along the direction of arrow L above the guide plate 44. On this occasion, the adhesive tape 52 is newly fed out from the tape supply portion 53. Then the adhesive tape 52 is cut by the cutter 54 to separate only the adhesive tape 52 on the bottom face of the sticking drum 51 from the other adhesive tape 52, and thereafter waits for next sticking work between the heat transfer recording sheet 1 and the lead sheet 50.

Further, the subshaft 61 is supplied from the subshaft supplying apparatus 29. As shown in FIG. 10, the subshaft 61 has a slit 110 in one end thereof. The subshaft supplying apparatus 29 detects this slit 110 to detect an orientation of the subshaft 61, corrects the orientation of the subshaft 61 if the orientation is opposite, and then supplies the subshaft to a carry arm 30 moving on a circular orbit.

The details of the slit detecting apparatus are described referring to FIG. 10 and FIGS. 11A–11C. As shown in FIG. 10 and FIGS. 11A–11C, the slit detecting apparatus has an infrared projector 111 and an infrared receiver 112 provided for each of the two ends of the subshaft 61, as arranged to detect the slit 110 by the infrared projector 111 and infrared receiver 112. The infrared receiver 112 is connected to an amplifier 113 having a comparator function and the amplifier 113 converts an analog signal from the infrared receiver 112 into a non-contact voltage output. This non-contact voltage output is input into a control unit 114. This control unit 114 drives a subshaft turning apparatus not shown to turn round a reversely oriented subshaft 61.

Although FIG. 10 shows only a set of infrared projector 111 and infrared receiver 112 provided at one end of subshaft 61 for convenience sake, there are two sets actually provided on either end of subshaft 61.

In the subshaft supplying apparatus 29, infrared rays are projected from the infrared projectors 111 to the both ends of the subshaft 61. In case of the slit 110 being formed in the subshaft 61, as shown in FIG. 11A, the infrared rays projected from the infrared projector 111 are directly received by the infrared receiver 112 through the slit 110, and an analog signal from the infrared receiver 112 is converted into a non-contact voltage output by the amplifier 113. The non-contact voltage output from the amplifier 113 is then input into the control unit 114. FIG. 11B shows the output from the infrared receiver 112 on this occasion and a comparator value of the amplifier, and FIG. 11C shows outputs from the amplifier 113.

As shown in FIGS. 11A, 11B, and 11C, the slit 110 in the subshaft 61 is represented by an output from the amplifier 113, whereby the control unit 114 can check absence or presence of the slit 110 in the subshaft 61. Since the infrared projectors 111 and infrared receivers 112 are set on the both ends of the subshaft 61 as described above, the control unit 114 can check which side has the slit 110 in the subshaft 61 or in which way the subshaft 61 is oriented, by specifying which infrared receiver 112 outputs a signal.

An adhesive 62*a* is applied to the subshaft 61 supplied from the subshaft supplying apparatus 29, along the axial direction thereof by an adhesive applying means such as a hot melt gun 62. Although there is no specific restrictions on a setting place of the hot melt gun, the hot melt gun is preferably set so that the adhesive is applied onto the bottom face of subshaft.

The subshaft sticking apparatus has, for example, a carry arm 30, which rotates about a shaft 30*a*. The carry arm 30 carries a subshaft 61 supplied and carried thereto to the subshaft sticking position 25 and urges the subshaft against the lead sheet 50 adhered to the sheet roll 26, thereby sticking the subshaft 61 to the end portion of the lead sheet 50 through the adhesive 61*a*.

The combination of the sheet roll 26, to which the subshaft is attached, with the subshaft 61 is carried to the lead sheet winding apparatus 27 provided on the downstream side of the subshaft sticking position 25, for example, by another carrying means such as a carry arm rotating about the shaft 30*a*.

Figure 9A:
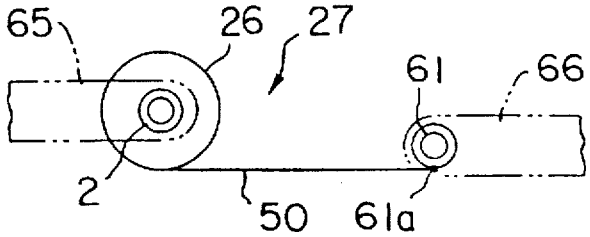
FIGS. 9A–9D are schematic drawings to show lead sheet winding apparatus.

In the lead sheet winding apparatus 27, the roll shaft 2 of the sheet roll 26 is rotatably held by the roll shaft support portion 65 while the subshaft 61 is rotatably held by the subshaft support portion 66 (FIG. 9A).

Figure 9B:
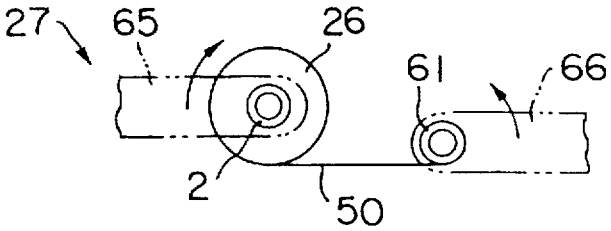
Figure 9C:
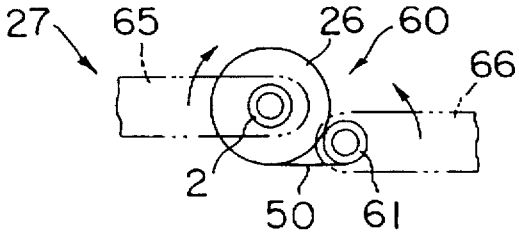

After that, the subshaft support portion 66 approaches the roll shaft support portion 65, so that the lead sheet 50 is wound up to wrap the sheet roll 26 and subshaft 61 (FIG. 9B). This method can obtain a C-shaped roll as shown in FIG. 9C.

Figure 9D:
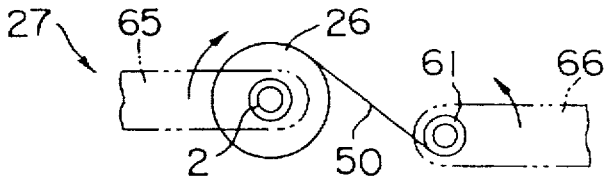

For some products, S-shaped rolls as shown in FIG. 9D are demanded. In that case, the roll is inverted up to down and left to right at an arbitrary point between the sticking of lead sheet and the sticking of subshaft, and then the subshaft is stuck to the roll. Thereafter, the lead sheet is wound up to obtain an S-shaped roll as shown in FIG. 9D.

Figure 12:
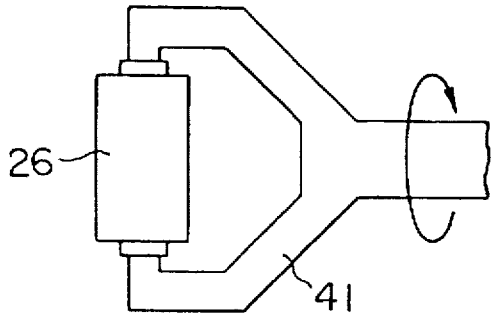
FIG. 12 is a schematic drawing to show a roll support portion.

For the up-to-down and left-to-right inversion of roll, a possible arrangement is for example as shown in FIG. 12, in which a roll support portion 41 installed on the turn table is arranged to be rotatable so as to invert the sheet roll 26 up to down and left to right. This method is advantageous because the sheet roll 26 can be obtained easily both in the C-shape and in the S-shape.

Figure 13:
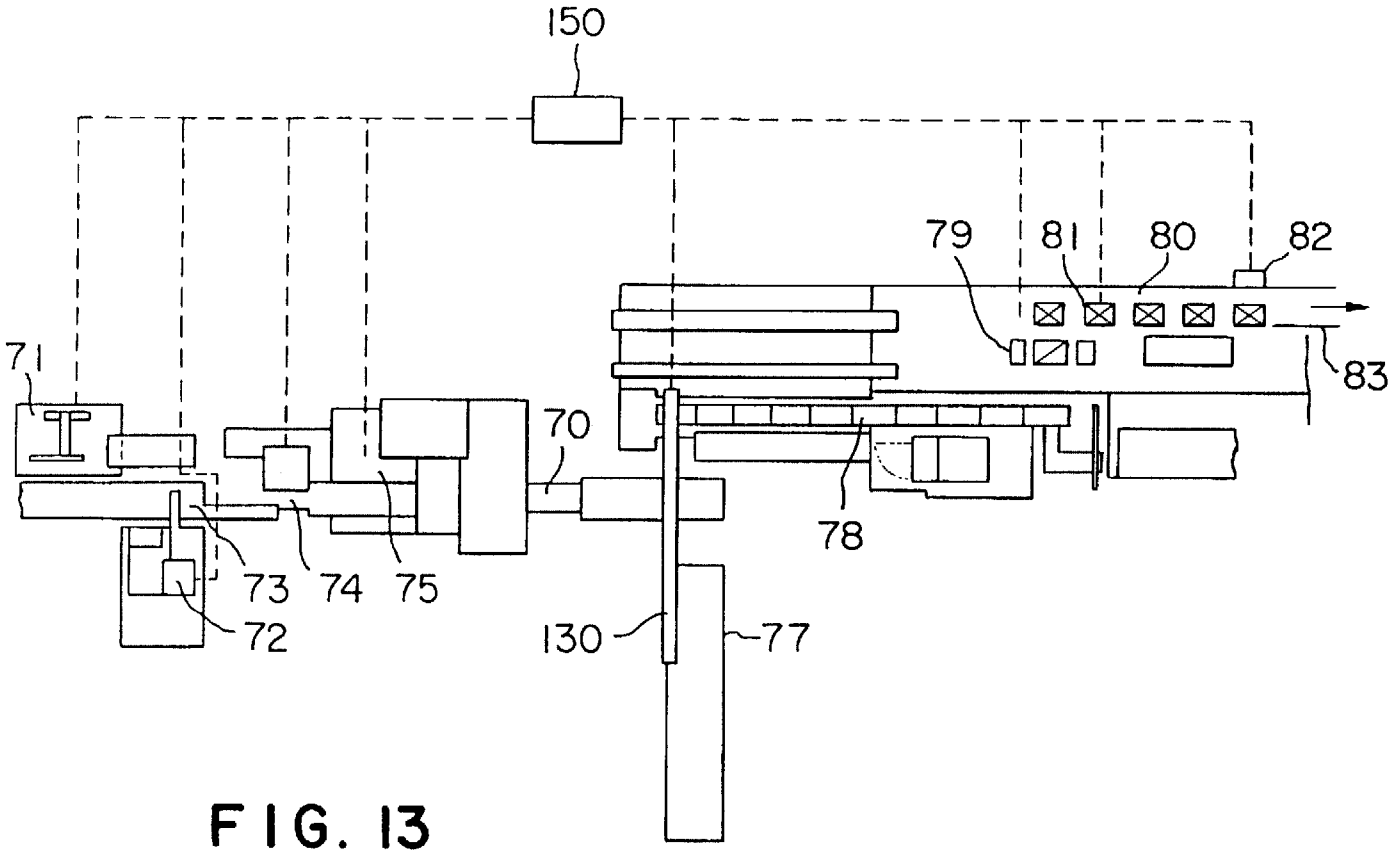
FIG. 13 is an overall schematic drawing to show a packaging apparatus for packaging a combination of a sheet roll with a subshaft according to the present invention.

In the above manner the apparatus forms the combination of the sheet roll 26 with the subshaft 61, wrapped with the lead sheet 50, and the resultant combination is carried to the tying portion 71 in the packaging apparatus of combination as shown in FIG. 13, for example by another carrying means such as a carry arm rotating about the shaft 30*a*.

Combination Packaging Apparatus

Next described referring to FIG. 13 to FIG. 24 is the packaging apparatus of combination 60 of the sheet roll with the subshaft.

Figure 15:
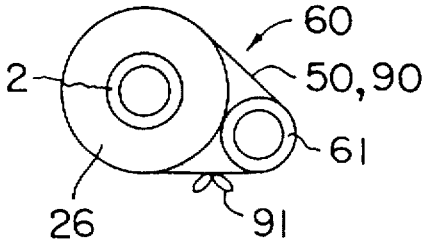
FIG. 15 is a drawing to show a combination tied with a strip by a tying portion.
Figure 16A:
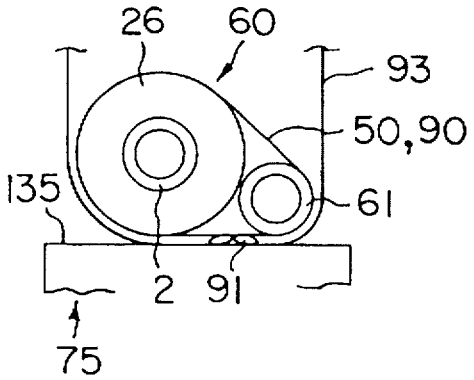
FIGS. 16A and 16B are drawings to show a packaging portion for packaging the combination with a package bag.
Figure 16B:
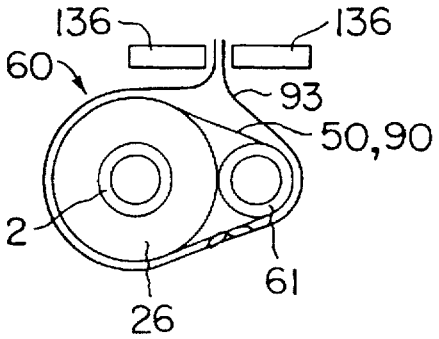

First, the packaging apparatus of combination 60 of the sheet roll with the subshaft is briefly described referring to FIG. 13. As shown in FIG. 13, the packaging apparatus is provided with a tying portion 71 for tying the combination 60 with a rubber strip 90 (FIG. 15) to bundle the combination 60, a label sticking portion 73, provided on the downstream side of the tying portion 71, for sticking a label of a predetermined lot number to the combination 60, a label and strip detecting portion 74 for detecting the label and the strip, and a packaging portion 75, provided on the downstream side of the label sticking portion 73, for packaging the tied combination 60 with a package bag 93 (FIGS. 16A and 16B).

These tying portion 71, label sticking portion 73, and packaging portion 75 are connected by a first carry line 70 for carrying the combination 60. Also, a label printer 72 is connected to the label sticking portion 73.

On the downstream side of the packaging portion 75 on the first carry line 70 there is a transferring and mounting portion 76 for laying an even number of combinations 60 packaged in package bags 93, for example two combinations, in a pallet 95 (FIG. 17) on a second carry line 78 while alternately inverting the orientations of combinations in order. Based on a signal from the label and strip detecting portion 74, the transferring and mounting portion 76 ejects through a first ejector 77 a combination 60 regarded as a defective item by a control unit 150.

Connected to the downstream end of the second carry line 78 is an encasing portion 79 for encasing two combinations 60 laid in the pallet 95 on the second carry line 78, in a container 97. The two combinations 60 encased in the container by the encasing portion 79 are then sent to a third carry line 80. The third carry line is provided with a sealing portion 81 for sealing the container 97 by applying a hot melt resin to the inner surface of the container 97. For the container 97 storing the two combinations 60 and sealed by the sealing portion 81, a time is counted between the coating of the hot melt resin and the assembling of the container. If this time is within a preset range, the container is determined as an acceptable item to be ejected from the ejection line 83. In contrast, if the time is out of the set range, the container is determined as a defective item to be ejected from a second ejector 82.

The above control unit 150 is arranged to drive-control the constituent portions of the packaging apparatus.

Figure 19:
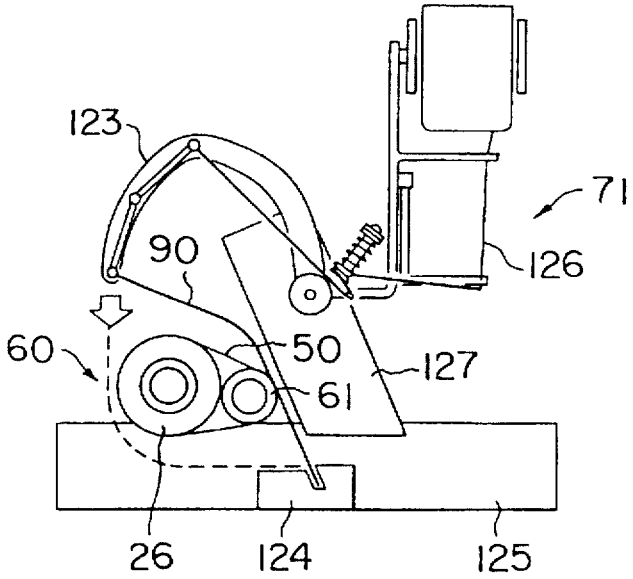
FIG. 19 is a drawing to show a tying portion for tying a combination with a strip.

The constituent portions will be described in detail as to the structure. The tying portion 71 is first described referring to FIG. 15 and FIG. 19. As shown in FIG. 15 and FIG. 19, the tying portion 71 has a support table 125 for supporting the combination 60 composed of the sheet roll and the subshaft, and an arm 123 pivotably attached to a column 127 vertically mounted on the support table 125. The support table 125 is provided with a fastening apparatus 124, and a rubber strip 90 extending on one side of combination 60 extends between the distal end of the arm 123 and the fastening apparatus 124. In this case, the arm 123 grips the base end of strip 90, moves to the other side of combination 60, and transfers the base end of strip 90 to the fastening apparatus 124.

The fastening apparatus 124 grips the fore end of the rubber strip 90 and fastens the base end of strip 90 transferred by the arm 123 to the fore end of strip 90, thereby combining the combination 60 in a bundle. After the fastening apparatus 124 has fastened the base end with the fore end of strip 90, a knot 91 is formed in the strip 90 (FIG. 15).

The packaging portion 75 is next described referring to FIGS. 16A and 16B. As shown in FIG. 16A and 16B, the packaging portion 75 has a filling portion 135, on which a plastic package bag 93 opening at the top edge is mounted, for filling a combination 60 in the package bag 93, and a heat seal portion 136 for heat-sealing the upper edge opening of the package bag 93 which was filled with the combination 60 by the filling portion 135.

When the heat seal portion 136 performs heat seal of the package bag 93, the heat seal is effected while holding the package bag 93 by an unrepresented holder. By this arrangement where the package bag 93 is set with the upper edge being open and the opening is heat-sealed, the heat from the heat seal portion can be prevented from transferring to the combination 60. This can prevent deterioration of the heat transfer recording sheet of the combination 60.

Namely, it is conceivably possible that in case of heat seal from the bottom of the package bag 93, the heat from the heat seal portion transfers to the above combination 60; but the present invention has such an effect that the heat from the heat seal portion 136 does not transfer to the combination 60. Also, the packaging portion 75 is provided with another heat seal portion (not shown) for heat-sealing the sides of the package bag 93 after heat-sealed at the upper opening by the heat seal portion 136.

Figure 17:
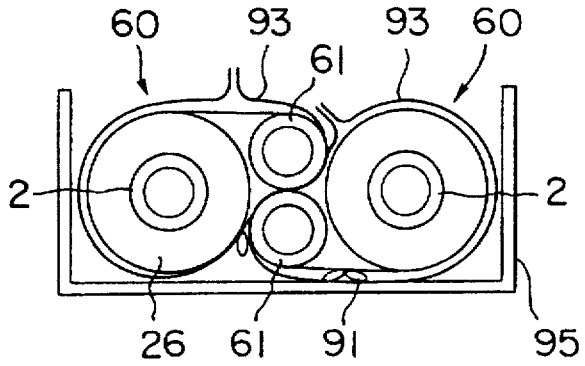
FIG. 17 is a drawing to show two combinations transferred and mounted in mutually opposite directions in a pallet by a transferring and mounting portion.
Figure 20:
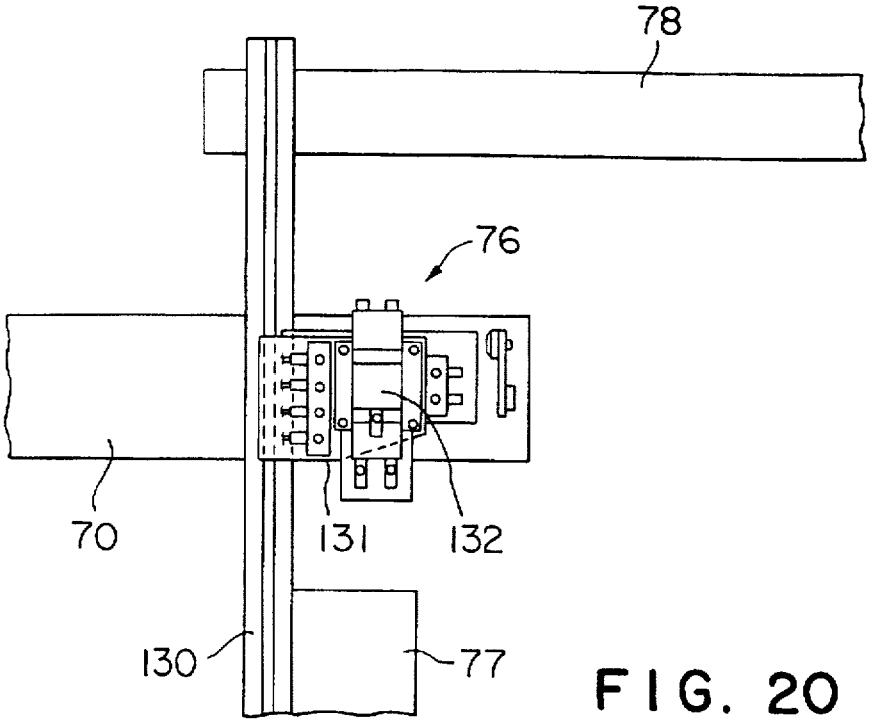
FIG. 20 is an enlarged plan view to show the transferring and mounting portion.
Figure 21:
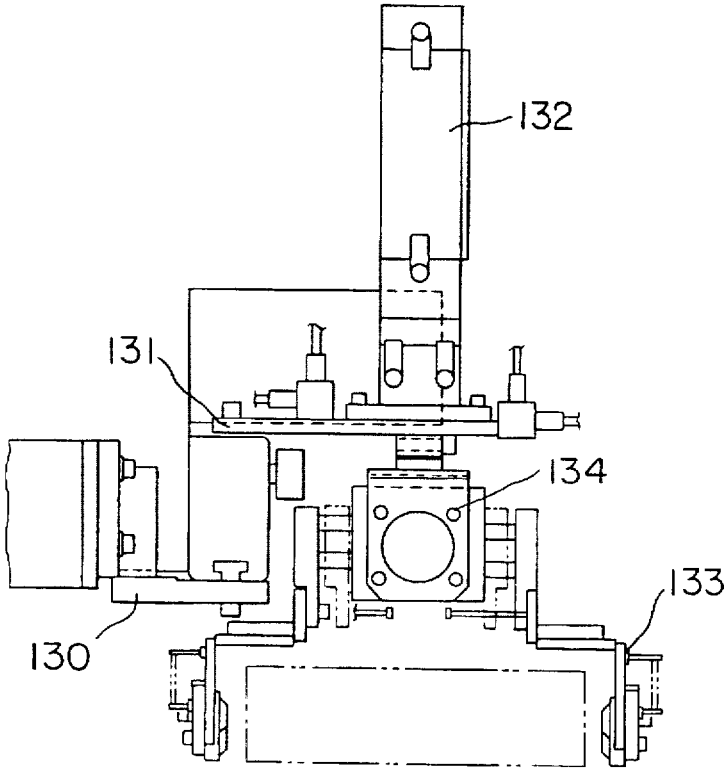
FIG. 21 is a side view to show the transferring and mounting portion.

The transferring and mounting portion 76 is next described referring to FIG. 17, FIG. 20, and FIG. 21. As shown in FIG. 13, FIG. 20, and FIG. 21, the transferring and mounting portion 76 has a rail 130 provided between the terminal end of the first carry line 70 and the start end of the second carry line 78 and being perpendicular to the first and second carry lines 70, 78. The rail 130 is provided with a support portion 131 moving along the rail 130, and an elevating cylinder 132 is supported on the support portion 131. A gripping portion 133 for gripping the combination 60 is mounted to the elevating cylinder 132 through a rotary cylinder 134, so that the gripping portion 133 vertically moves up and down by the elevating cylinder 132 and rotates on a horizontal plane by the rotary cylinder 134.

This gripping portion 133 grips the combination 60 on the first carry line 70 to transfer it to the second carry line 78, and mounts the combination in a pallet 95 mounted on the second carry line 78. In this case, as shown in FIG. 17, the gripping portion 133 horizontally rotates combinations 60 by 180 degrees alternately in order to transfer and mount them in the pallet 95. Thus, for example if two combinations 60 are transferred and mounted in the pallet 95, two sheet rolls 26 are located each on either side in the pallet 95 and two subshafts at the center portion, whereby two combinations 60 are stored in a nearly rectangular parallelepiped shape in the pallet 95.

The encasing portion 79 is next described referring to FIG. 18, and FIG. 22A to FIG. 24. As shown in FIG. 18, and FIG. 22A to FIG. 24, the encasing portion 79 has a storing portion 142 for storing a lot of foldable cartons 140, and a containing portion 141 to which the foldable cartons 140 are sent one by one from the storing portion 142, in which each carton 140 is placed to store two combinations 60 therein, and which produces a container 97 from the carton 140.

In more detail, the containing portion 141 has an opening formed in a nearly same shape as a bottom face 140*a* of the carton 140, and the bottom face 140*a* is located on the opening. Then two combinations 60 in the pallet 95 are pushed by a carrying means 100 from the side of pallet 95 in the direction of the arrow in FIG. 23, thereby being transferred onto the bottom face 140*a* of carton 140. Then the two combinations 60 are pushed downward so as to drop the bottom face 140*a* into the opening, whereby the side walls of the opening bring the side faces 140*b* of carton 140 into a vertically standing state. The container 97 is thus assembled from the carton 140 in this manner.

When the carton 140 is sent from the storing portion 142 to the containing portion 141, a hot melt resin 145 is applied to flaps 140*d* of the carton 140 by a hot melt gun not shown. When the container 97 is assembled in the containing portion 141, the hot melt resin 145 adheres the side faces 140*b* to the flaps 140*d*.

Then the container 97 containing two combinations 60 is sent from the third carry line 80 to the sealing portion 81. In the sealing portion 81, a top face 140*c* covers the container 97, and an additional hot melt resin (not shown) is applied to the top face 140*c*. This additional hot melt resin seals the top face 140*c*.

Next described is the operation of the present embodiment constructed in the above structure.

First, in the preliminary step, the lead film 50 is first wound up to wrap the sheet roll 26 and the subshaft 61 with a smaller diameter than that of the sheet roll 26 to produce the combination 60 of the sheet roll and the subshaft (FIG. 14), and the combination 60 is sent to the tying portion 71.

In the tying portion 71, the combination 60 is mounted on the support table 125, as shown in FIG. 19. On this occasion, the rubber strip 90 located on one side of the combination 60 extends between the arm 123 and the fastening apparatus 124 in the support table 125 (at the position of the solid line in FIG. 19).

Then the arm 123 moves to the other side of combination 60, so that the base end of the strip 90 gripped by the arm 123 is transferred to the fore end side of the strip 90 gripped by the fastening apparatus 124; and then the fore end and the base end of strip 90 are fastened to each other by the fastening apparatus 124 to form the knot 91 (FIG. 15).

In the next step, the combination 60, tied with the strip 90 in the tying portion 71, is carried to the label sticking portion 73 by the first carry line 70, and a label of a predetermined lot number is stuck to the combination by the label sticking portion 73. The label to be stuck by the label sticking portion 73 is printed by the label printer 72 in accordance with a corresponding combination 60, and then the printed label is sent to the label sticking portion 73.

Then the combination 60 is carried by the first carry line 70 to the label and strip detecting portion 74, and the label and strip detecting portion 74 detects whether or not the label stuck to the combination 60 and the strip of the combination 60 are correctly mounted.

The combination 60 is next carried by the first carry line 70 to the packaging portion 75, and the packaging portion 75 packages the combination 60 with the package bag 93.

In more detail, the filling portion 135 first sets the combination 60 in the package bag 93 opening at the upper edge, and the package bag 93 with the combination 60 therein is sent to the heat seal portion 136 to be heat-sealed thereby. The heat seal portion 136 heat-seals the upper opening of the package bag 93, which prevents the heat from the heat seal portion 136 from transferring to the combination 60 and which in turn prevents the heat transfer recording sheet of the combination 60 from deteriorating.

Figure 22A:
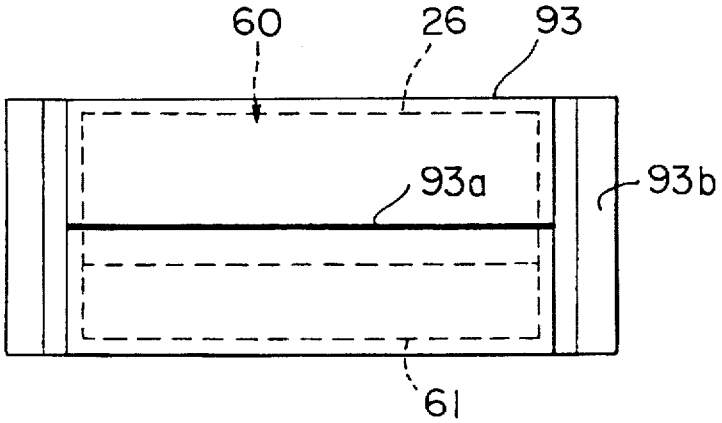
FIGS. 22A and 22B are drawings to show a combination packaged in a package bag by the packaging portion.
Figure 22B:
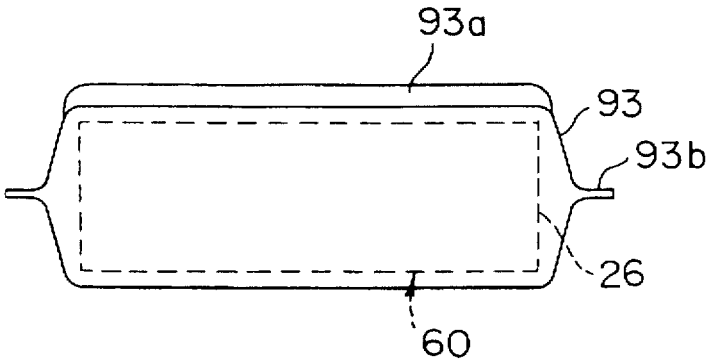

The package bag 93 containing the combination 60 therein and heat-sealed at the upper opening is next heat-sealed on the sides thereof by the side heat seal portion. In this manner, as shown in FIGS. 22A and 22B, seal portions 93*a*, 93*b* are formed at the upper edge and the sides, thereby obtaining the package bag 93 containing the combination 60 therein.

Then the combination 60 packed in the package bag 93 is carried by the first carry line 70 to the transferring and mounting portion 76. In the transferring and mounting portion 76, as shown in FIG. 20 and FIG. 21, the support portion 131 moves along the rail 130 to approach the combination 60 reaching the terminal end of the first carry line 70. Then the gripping portion 133 is lowered by the elevating cylinder 132 to grip the combination 60. The gripping portion 133 then ascends, and the support portion 131 moves along the rail 130 to go to above the second carry line 78, where the gripping portion 133 is lowered to transfer the combination 60 into the pallet 95 on the second carry line 78 (FIG. 17).

When the next combination 60 reaches the transferring and mounting portion 76, the above operation is repeated to lay the next combination 60 on the combination 60 already mounted in the pallet 95. On this occasion, during the period when the support portion 131 moves from the first carry line 70 to the second carry line 78, the gripping portion 133 horizontally rotates 180 by 180 degrees whereby the next combination 60 is laid in a 180 degree turned state with respect to the already mounted combination 60 (FIG. 17). Thus, the two combinations 60 are set in a nearly rectangular parallelepiped shape in the pallet 95.

Based on a signal from the label and strip detecting portion 74, the gripping portion 133 grips a combination 60 regarded as a defective item by the control unit 150, and transfers it not to the second carry line 78 but to the first ejector 77, which ejects it as a defective item.

Then the pallet 95 containing the two combinations 60 is carried by the second carry line 78 to reach the terminal end of the second carry line 78.

Figure 23:
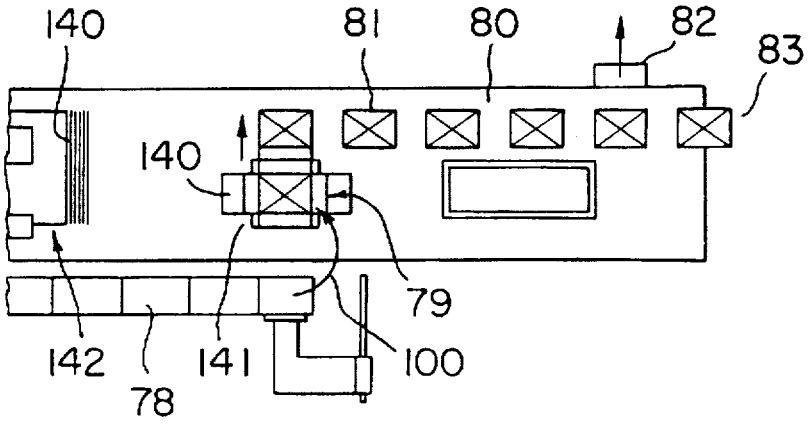
FIG. 23 is an enlarged plan view to show an encasing portion.
Figure 24:
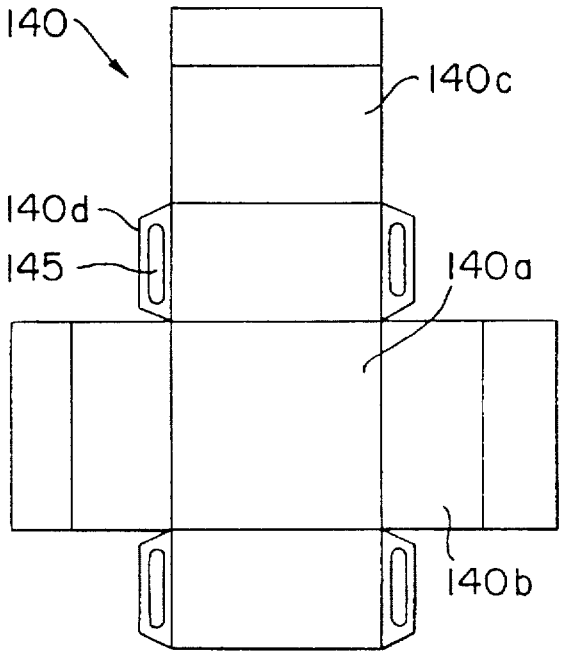
FIG. 24 is a plan view to show a foldable carton which is used in the encasing portion to form a container.

Next, as shown in FIG. 23 and FIG. 24, the carrying means 100 transfers the two combinations 60 in the pallet 95 onto the carton 140 mounted on the containing portion 141 in the encasing portion 79. In this case, because the carton 140 is preliminarily sent from the storing portion 142 to the containing portion 141, the two combinations 60 are transferred onto the bottom face 140*a* of the carton 140. The two combinations 60 are further pressed on the bottom face 140*a* of the carton 140, thereby dropping the bottom face 140*a* into the opening. As the bottom face 140*a* drops into the opening, the side walls of the opening bring the side faces of the carton 140 into a vertically standing state, thereby assembling the container 93 from the carton 140.

Since the hot melt resin 145 is preliminarily applied to the carton 140 mounted on the containing portion 141, the hot melt resin 145 adheres the side faces 140*b* of the carton 140 to the flaps 140*d* upon assembling the container 97 from the carton 140.

On this occasion, the time is counted between the application of the hot melt resin and the adhesion of the side faces to the flaps.

Then the container 97 containing the two combinations 60 therein is sent from the containing portion 141 to the third carry line 80, and the third carry line 80 carries it to the sealing portion 81. In the sealing portion 81, an additional hot melt resin is applied to the top face 140*c*, and the container 97 is sealed as covered by the top face 140*c*.

The time is also counted between the application of the additional hot melt resin and the sealing on this occasion.

Figure 18:
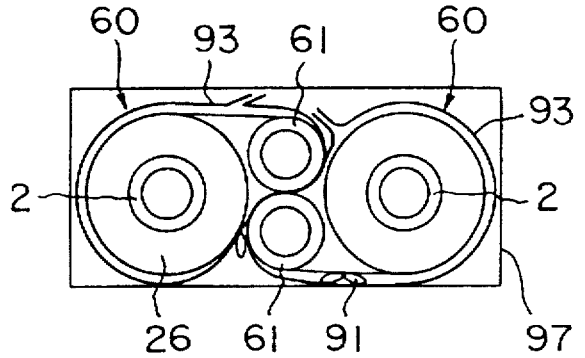
FIG. 18 is a drawing to show a container unit which contains two combinations in mutually opposite directions in a container.

In this manner a container unit of combinations is obtained in an arrangement containing a pair of combinations 60 in the container 97, as shown in FIG. 18. In this arrangement, as shown in FIG. 18, the sheet rolls 26 with a larger diameter are located on the both sides inside the container 97 and two subshafts 61 with a smaller diameter at the center portion, whereby the two combinations 60 are set in a nearly rectangular parallelepiped shape in the pallet 95.

Next, sent to the control unit 150 are signals of the time between the application of the hot melt resin and the adhesion of the side faces to the flaps and the time between the application of the additional hot melt resin and the sealing as to the container 97 containing the two combinations 60.

The container 97 regarded as an acceptable item (with which the above times are within the range of the preset time) by the control unit 150 is then ejected from the ejection line 83 to the normal ejection route.

The container 97 regarded as a defective item (with which either of the above times is out of the range of the preset time) by the control unit 150 is ejected from the second ejector 82.

As described above, the present embodiment can set the two combinations 60 in the container 97 in a compact form and can easily and quickly seal the container 97 and eject the sealed container.

The above embodiment showed an example in which two combinations 60 were contained in the container 97, but it is also possible that an even number of combinations 60, for example, four, six, or eight combinations, are contained in the container as alternately changing the orientations thereof.

As described above, the present invention permits an even number of combinations to be stored in a container as alternately changing the orientations thereof. In this case, because a combination is composed of a sheet roll with a larger diameter and a subshaft with a smaller diameter, the combinations can be stored in a compact form in the container by setting the even number of combinations as alternately changing the orientations thereof. Also, the present invention permits the container for combinations to be easily and quickly produced as setting combinations in the container. Further, the combination can be readily formed by winding up the lead film so as to wrap the sheet roll and the subshaft, and such combinations can be packed easily and continuously into the containers.

What is claimed is:

1. A combination producing system for producing a combination of a sheet roll with a subshaft, comprising:

a combination producing apparatus for winding up a lead sheet to wrap (i) a sheet roll obtained by winding a heat transfer recording sheet around an outer periphery of a roll shaft and (ii) a subshaft with a smaller diameter than that of the sheet roll, thereby producing the combination of a sheet roll with a subshaft; and a combination packaging apparatus for packaging the combination of a sheet roll with a subshaft, in a package bag and transferring packaged combinations into a container as alternately reversing orientations thereof to encase the combinations in the container.

2. The combination producing system for producing a combination of a sheet roll with a subshaft according to claim 1, wherein said combination producing apparatus comprises:

an uncrumpling and cutting apparatus for cutting an end portion of the heat transfer recording sheet of the sheet roll obtained by winding the heat transfer recording sheet around the outer periphery of the roll shaft, by a predetermined length;

a lead sheet sticking apparatus provided on a downstream side of said uncrumpling and cutting apparatus, for making one side edge of a lead sheet of a predetermined length overlap with the cut end portion of the heat transfer recording sheet thus cut and sticking said one side edge to the end portion by sticking means;

a subshaft sticking apparatus provided on a downstream side of said lead sheet sticking apparatus, for sticking the subshaft to another side edge of the lead sheet stuck to said sheet roll; and a lead sheet winding apparatus provided on a downstream side of said subshaft sticking apparatus, for winding up said lead sheet so as to wrap said sheet roll and said subshaft with said lead sheet.

3. The combination producing system for producing a combination of a sheet roll with a subshaft according to claim 2, wherein said uncrumpling and cutting apparatus comprises a horizontal support table having a suction portion on a top surface thereof, a rotation drive apparatus for rotating the sheet roll on the horizontal support table so as to leave an end portion of a predetermined length of the heat transfer recording sheet on said horizontal support table, and a cutter provided on said horizontal support table, for cutting off said end portion of said heat transfer recording sheet.

4. The combination producing system for producing a combination of a sheet roll with a subshaft according to claim 2, wherein said lead sheet sticking apparatus comprises a roll support portion for rotatably supporting the sheet roll, a supplying apparatus for supplying one side edge of the lead sheet to the sheet roll, a mount stage on which the one side edge of the lead sheet is made to overlap with the cut end of the sheet roll, a cutting apparatus provided near the mount stage, for cutting said lead sheet, and a sticking apparatus provided either above or below said mount stage, for sticking the cut end of the sheet roll to the one side edge of the lead sheet with a sticking tape.

5. The combination producing system for producing a combination of a sheet roll with a subshaft according to claim 2, wherein said subshaft sticking apparatus has means for applying an adhesive to the subshaft supplied from a subshaft supplying apparatus, and means for carrying the subshaft to which the adhesive is applied, to a subshaft sticking position to stick the subshaft to the lead sheet.

6. The combination producing system for producing a combination of a sheet roll with a subshaft according to claim 2, wherein said lead sheet winding apparatus has a roll shaft support portion for supporting and rotating the roll shaft of the sheet roll, and a subshaft support portion for supporting and rotating the subshaft.

7. The combination producing system for producing a combination of a sheet roll with a subshaft according to claim 1, wherein said combination packaging apparatus comprises:

a tying portion for tying with a strip the combination of a sheet roll with a subshaft, formed by winding up the lead sheet to wrap therewith the sheet roll obtained by winding the heat transfer recording sheet around the outer periphery of the roll shaft, and the subshaft with a smaller diameter than that of the sheet roll;

a packaging portion provided on a downstream side of the tying portion, for packaging said combination thus tied with a package bag;

a transferring and mounting portion provided on a downstream side of the packaging portion, for laying combinations packaged in package bags as alternately reversing orientations thereof; and an encasing portion provided on a downstream side of the transferring and mounting portion, for encasing the combinations laid by the transferring and mounting portion, in a container.

8. The combination producing system for producing a combination of a sheet roll with a subshaft according to claim 7, wherein said tying portion has a support table for supporting the combination, an arm for gripping a base end of the strip extending on one side of the combination and arranged to be movable to the other side of the combination, and a fastening apparatus for gripping a fore end of said strip and fastening the base end transferred by the arm to the fore end of the strip.

9. The combination producing system for producing a combination of a sheet roll with a subshaft according to claim 7, wherein a label sticking portion for sticking a label of a predetermined lot number to the combination is provided between the tying portion and the packaging portion.

10. The combination producing system for producing a combination of a sheet roll with a subshaft according to claim 7, wherein said packaging portion has a filling portion for filling a package bag opening at one side, with combinations, and a heat seal portion for heat-sealing the opening of the package bag.

11. The combination producing system for producing a combination of a sheet roll with a subshaft according to claim 7, wherein said encasing portion has a containing portion, on which a foldable container carton is placed for containing the combinations to produce a container from the carton, and a sealing portion for sealing the container containing the combinations.

12. A combination producing apparatus for producing a combination of a sheet roll with a subshaft, comprising:

an uncrumpling and cutting apparatus for cutting an end portion of a heat transfer recording sheet of a sheet roll obtained by winding the heat transfer recording sheet around an outer periphery of a roll shaft, by a predetermined length;

a lead sheet sticking apparatus provided on a downstream side of said uncrumpling and cutting apparatus, for making one side edge of a lead sheet of a predetermined length overlap with the cut end portion of the heat transfer recording sheet thus cut and sticking said one side edge to the end portion by sticking means;

a subshaft sticking apparatus provided on a downstream side of said lead sheet sticking apparatus, for sticking a subshaft to another side edge of the lead sheet stuck to said sheet roll; and a lead sheet winding apparatus provided on a downstream side of said subshaft sticking apparatus, for winding up said lead sheet so as to wrap said sheet roll and said subshaft with said lead sheet.

13. The combination producing apparatus for producing a combination of a sheet roll with a subshaft according to claim 12, wherein said uncrumpling and cutting apparatus comprises a horizontal support table having a suction portion on a top surface thereof, a rotation drive apparatus for rotating the sheet roll on the horizontal support table so as to leave an end portion of a predetermined length of the heat transfer recording sheet on said horizontal support table, and a cutter provided on said horizontal support table, for cutting off said end portion of said heat transfer recording sheet.

14. The combination producing apparatus for producing a combination of a sheet roll with a subshaft according to claim 12, wherein said lead sheet sticking apparatus comprises a roll support portion for rotatably supporting the sheet roll, a supplying apparatus for supplying one side edge of the lead sheet to the sheet roll, a mount stage on which the one side edge of the lead sheet is made to overlap with the cut end of the sheet roll, a cutting apparatus provided near the mount stage, for cutting said lead sheet, and a sticking apparatus provided either above or below said mount stage, for sticking the cut end of the sheet roll to the one side edge of the lead sheet with a sticking tape.

15. The combination producing apparatus for producing a combination of a sheet roll with a subshaft according to claim 12, wherein said subshaft sticking apparatus has means for applying an adhesive to the subshaft supplied from a subshaft supplying apparatus, and means for carrying the subshaft to which the adhesive is applied, to a subshaft sticking position to stick the subshaft to the lead sheet.

16. The combination producing apparatus for producing a combination of a sheet roll with a subshaft according to claim 12, wherein said lead sheet winding apparatus has a roll shaft support portion for supporting and rotating the roll shaft of the sheet roll, and a subshaft support portion for supporting and rotating the subshaft.

17. A combination packaging apparatus for packaging a combination of a sheet roll with a subshaft, comprising:

a tying portion for tying with a strip a combination of a sheet roll with a subshaft, formed by winding up a lead sheet to wrap therewith the sheet roll obtained by winding a heat transfer recording sheet around an outer periphery of a roll shaft, and the subshaft with a smaller diameter than that of the sheet roll;

a packaging portion provided on a downstream side of the tying portion, for packaging said combination thus tied with a package bag;

a transferring and mounting portion provided on a downstream side of the packaging portion, for laying combinations packaged in package bags as alternately reversing orientations thereof; and an encasing portion provided on a downstream side of the transferring and mounting portion, for encasing the combinations laid by the transferring and mounting portion, in a container.

18. The combination packaging apparatus for packaging a combination of a sheet roll with a subshaft according to claim 17, wherein said tying portion has a support table for supporting the combination, an arm for gripping a base end of the strip extending on one side of the combination and arranged to be movable to the other side of the combination, and a fastening apparatus for gripping a fore end of said strip and fastening the base end transferred by the arm to the fore end of the strip.

19. The combination packaging apparatus for packaging a combination of a sheet roll with a subshaft according to claim 17, wherein a label sticking portion for sticking a label of a predetermined lot number to the combination is provided between the tying portion and the packaging portion.

20. The combination packaging apparatus for packaging a combination of a sheet roll with a subshaft according to claim 17, wherein said packaging portion has a filling portion for filling a package bag opening at one side, with combinations, and a heat seal portion for heat-sealing the opening of the package bag.

21. The combination packaging apparatus for packaging a combination of a sheet roll with a subshaft according to claim 17, wherein said encasing portion has a containing portion, on which a foldable carton for container is placed for containing the combinations to produce a container from the carton, and a sealing portion for sealing the container containing the combinations.

22. A combination producing system for producing a combination of a sheet roll with a subshaft, comprising:

an uncrumpling and cutting apparatus for cutting an end portion of a heat transfer recording sheet of a sheet roll obtained by winding the heat transfer recording sheet around an outer periphery of a roll shaft, by a predetermined length;

a lead sheet sticking apparatus provided on a downstream side of said uncrumpling and cutting apparatus, for making one side edge of a lead film of a predetermined length overlap with the cut end of the heat transfer recording sheet thus cut and sticking them to each other with sticking means;

a subshaft sticking apparatus provided on a downstream side of said lead sheet sticking apparatus, for sticking a subshaft to another side edge of the lead film stuck to said sheet roll;

a lead sheet winding apparatus provided on a downstream side of said subshaft sticking apparatus, for winding up said lead film so as to wrap said sheet roll and said subshaft with said lead film;

a tying portion for tying with a strip a combination of a sheet roll with a subshaft, formed by winding up the lead film so as to wrap the sheet roll and the subshaft with a smaller diameter than that of the sheet roll, by said lead sheet winding apparatus;

a packaging portion provided on a downstream side of the tying portion, for packaging said combination thus tied with a package bag;

a transferring and mounting portion provided on a downstream side of said packaging portion, for transferring combinations packaged with package bags as alternately reversing orientations thereof; and an encasing portion provided on a downstream side of said transferring and mounting portion, for encasing the combinations laid by the transferring and mounting portion, in a container.

* * * * *